US010272695B2

(12) United States Patent
Wilkinson et al.

(10) Patent No.: US 10,272,695 B2
(45) Date of Patent: Apr. 30, 2019

(54) PROCESS FOR MANUFACTURING A WOVEN LABEL, CONTAINING A UNIQUE INFORMATION, ELECTRONICALLY READABLE

(71) Applicant: CODING MANAGEMENT S.A., Luxembourg (LU)

(72) Inventors: Paul Wilkinson, Luxembourg (LU); Arno Montorfano, Luxembourg (LU)

(73) Assignee: CODING MANAGEMENT S.A., Luxembourg (LU)

( * ) Notice: Subject to any disclaimer, the term of this patent is extended or adjusted under 35 U.S.C. 154(b) by 0 days.

(21) Appl. No.: 15/524,667

(22) PCT Filed: Sep. 17, 2015

(86) PCT No.: PCT/IB2015/057153
§ 371 (c)(1),
(2) Date: May 5, 2017

(87) PCT Pub. No.: WO2016/042508
PCT Pub. Date: Mar. 24, 2016

(65) Prior Publication Data

US 2017/0259586 A1 Sep. 14, 2017

(30) Foreign Application Priority Data

Sep. 17, 2014 (CH) ..... 1403/14
Sep. 25, 2014 (IT) ..... RM2014A0549

(51) Int. Cl.
*D06P 3/52* (2006.01)
*D06P 5/24* (2006.01)
(Continued)

(52) U.S. Cl.
CPC ..... *B41J 3/4078* (2013.01); *B41J 2/04536* (2013.01); *B41J 2/04586* (2013.01);
(Continued)

(58) Field of Classification Search
CPC .. B41J 3/4078; B41J 2/04586; B41J 2/04536; G09F 3/0297; G09F 2003/0282;
(Continued)

(56) References Cited

U.S. PATENT DOCUMENTS 5,100,718 A 3/1992 Weintraub
2010/0035027 A1* 2/2010 Hill ..... G09F 3/02 428/195.1

FOREIGN PATENT DOCUMENTS

EP 0568709 11/1993
EP 1302330 A1 4/2003
(Continued)

OTHER PUBLICATIONS

International Search Report of PCT/IB2015/057153 and Written Opinion dated Jan. 19, 2016.
(Continued)

*Primary Examiner* — Bradley W Thies

(57) ABSTRACT

Process for making a fabric label (1) containing one piece of unique electronically-readable information; characterized by comprising the following steps: providing a fabric bolt made of a material mainly comprising synthetic fibers at least in the weft, generating at least one array of m×n cells, being n the number of rows and m the number of columns; generating at least one first sequence of variable information (3); associating the variable information (3) to the cells of the previous array in compliance with a predetermined logic; inserting, by the use of an image assembler, the graphic form that can be associated with each of said variable information (3) into a cell of a graphics array (5) with size m×n; printing said array (5) of images on a first medium (8) through a digital printing process; transferring said print, by heating, through a process named sublimation on said bolt (7) to generate a second medium (9) of fabric comprising said array (5); storing in a database the variable information (3)
(Continued)

printed on each label (1), taking care of tuning the column m and the row n on which every information has been positioned; cutting the second medium (9) of fabric in m ribbons or labels rows (12) having size adapted to be wound on bobbins (13) that are wide as wide the single cell is.

23 Claims, 5 Drawing Sheets

(51) Int. Cl.

| | |
|---|---|
| ***D06P 5/30*** | (2006.01) |
| ***G09F 3/00*** | (2006.01) |
| ***G09F 3/02*** | (2006.01) |
| ***B41J 2/045*** | (2006.01) |
| ***B41J 3/407*** | (2006.01) |

(52) U.S. Cl.
CPC ..... *D06P 3/52* (2013.01); *D06P 5/003* (2013.01); *D06P 5/30* (2013.01); *G09F 3/0297* (2013.01); *G09F 2003/0225* (2013.01); *G09F 2003/0226* (2013.01); *G09F 2003/0282* (2013.01)

(58) Field of Classification Search
CPC ..... G09F 2003/0225; D06P 3/52; D06P 5/30; D06P 5/003
See application file for complete search history.

(56) References Cited

FOREIGN PATENT DOCUMENTS

| | | | |
|---|---|---|---|
| EP | 1533348 A1 | 5/2005 | |
| WO | 99/47254 | 9/1999 | |
| WO | 0169324 | 9/2001 | |
| WO | WO 0169324 A1 * | 9/2001 | ..... D06P 5/001 |

OTHER PUBLICATIONS

International Preliminary Report on Patentability of PCT/IB2015/057153 dated Mar. 21, 2017.
Office Action dated Aug. 31, 2018 in counterpart European Application No. 15 784 767.4-1107.

* cited by examiner

PROCESS FOR MANUFACTURING A WOVEN LABEL, CONTAINING A UNIQUE INFORMATION, ELECTRONICALLY READABLE

RELATED APPLICATIONS

This application is the US national phase application of international application number PCT/IB2015/057153, filed Sep. 17, 2015, which designates the US and claims priority to Italian application RM2014A000549 filed Sep. 25, 2014 and Swiss application 0143/14 filed Sep. 17, 2014, the contents of each of which are hereby incorporated by reference as if set forth in their entireties.

FIELD OF THE INVENTION

The present invention relates to the field of the individual identification of items by means of labels made of fabric on which one piece of unique information per each label is printed, or more, which are also colored on one or both sides.

KNOWN ART

As known, the individual identification of items of clothing or fashion accessories by means of fabric labels is obtained by weaving processes able to generate unique labels, the labels being numbered either with electronically-readable codes of mono/two-dimensional types or being digitally printed. These processes are, in fact, the only ones able to provide large quantities of labels containing variable data readable with electronic equipments.

Among these, one of the processes is the weaving of variable data in which, by means of a suitable loom, labels containing variable data contained in alphanumeric codes or coded in mono/two-dimensional codes visible on the surface of the label, are woven.

The Applicant observed that such a process involves:

- poor graphic sharpness of texture, involving restrictions on information density that can be inserted in a code (typically in a QR);
- very low productivity and high rates of industrial investments per produced unit; and,
- exponential complexity as a function of the number of colors to be on the label.

An alternative process is represented by embroidery of variable data.

In this process the information, either variable or fixed, is embroidered on a label.

Applicant observed that such a process usually has poor sharpness of embroidered images, which generally makes impractical the application of codes with high information density on the label itself, furthermore the embroidery process just lends itself to a production in large series.

Another process is denoted by the heat transfer printing.

The Applicant observed that this process consists in transferring a drawing from one or more inked substrates onto a substrate.

Such a step is carried out by sliding a substrate and an inked film under a head containing many elements that can be heated dynamically and individually. Depending on how the single elements of each head are heated, when the substrate and the inked film pass, a monochromatic image is obtained that can be varied for each printed unit, within certain limits. The electronic control of heatable elements allows making drawings that are easily variable from one another and have standard resolution and high sharpness, in addition to be electronically well readable.

Theoretically, using a number of mutually synchronized and tuned heads also allows obtaining colored images although with very poor quality, since the controlling of the mutual tuning of print signals with different colors is very complex and controlling the intensity of the deposited color is not possible (said in term of art as grayscale).

The Applicant also noted that, according to this process, the use is necessary of special substrates designed to promote the transfer and the adhesion of the ink from the inked film, these substrates are typically very rigid and not very suitable to remain in contact with the skin of a person wearing such a labeled garment; in fact, it is normal practice for the consumer to remove regularly this label, with a loss of information depicted thereon.

The Applicant also noted that, in this process, the incidence of material cost is high and that, in case of color printing, such a cost is extremely high.

In addition, these labels have an appearance unsuited to be applied on items of clothing or fashion accessories.

In an attempt to solve problems typical of labels made by heat transfer printing, a method of making labels by inkjet printing directly on the fabric was developed.

The process consists in printing, by inkjet printing, fixed and variable information on a bolt of properly pretreated fabric, and in a subsequent "fixing" of printed colors which generally takes place, depending on the chemical nature of used inks, by heating the ink in a humid environment or by UV polymerizing it, a trimming from the bolt of printed labels follows.

The Applicant noted that such a process is complex and expensive due to the activities of preparation of the bolt and subsequent "setting" of printed colors, although solving the problems of controlling the intensity of colors and the precise positioning in which the latter are deposited onto the substrate; it also noted that with this process the ink tends to "flow" by capillarity along the fibers and, therefore, to reduce the image sharpness, this resulting in a considerable limitation in the density of variable information that can be inserted in mono and two-dimensional codes, in a poor image quality and high consumption of ink.

In addition, this process is generally not very compatible with fabrics based on synthetic fibers, in particular polyester, thereby complicating the cutting process and increasing the costs of materials.

More generally, the Applicant noted that most of the above described processes of making fabric labels with variable information does not allow applying variable or fixed information simultaneously on the front and the back of the label (exception is the process of heat transfer printing, however being limited by other above mentioned problems).

Therefore, the Applicant found the need to provide a new process for making a label on which at least one piece of unique variable information is printed and in which information is readable through electronic equipment, not having an excessive limitation in the density of variable information that can be inserted in mono and two-dimensional codes and a high ink consumption due to the fact that, during the printing step, the ink tends to "flow" by capillarity along the fibers and then to reduce the clearness and definition of the image.

Therefore, in particular the Applicant found the need to provide a new process for making a label on which at least one piece of unique variable information is printed and in which the information is readable through electronic equipment, obtaining a resolution of at least 150*150 DPI (dots per inch).

In particular, the Applicant found the need to provide a new process for making a fabric label on which one piece of unique variable information, or more, is applied and in which the labels can be read through electronic equipment.

SUMMARY OF THE INVENTION

Therefore, in its first aspect, the invention concerns a process for making a fabric label containing one piece of unique electronically-readable information; characterized by comprising the following steps:

- providing a fabric bolt made of a material comprising synthetic fibers at least in the weft;
- generating at least one array of m×n cells, being n the number of rows and m the number of columns;
- generating at least one first sequence of variable information;
- associating the variable information to the cells of the previous array in compliance with a predetermined logic;
- inserting, by the use of an image assembler, the graphic form that can be associated with each of said variable information into a cell of a graphics array with size m×n;
- printing said array of images on a first surface of a first medium through a digital printing process;
- contacting said first surface with said first bolt;
- transferring said print, by heating and sublimating the ink through a process called sublimation, onto said bolt to generate a second medium of fabric comprising said array;
- storing in a database the variable information printed on each label, taking care of tuning the column m and the row n on which every information has been positioned;
- cutting said second medium of fabric for making the labels.

In the scope of the present invention:

"Information of a fixed type" means a piece of information equal for all the labels made in the same batch.

Fixed information can be graphical representations of any type, a writing, a drawing, a trademark, a logo, an identification code such as for example a EAN code.

On the contrary, "information of a variable type" means information that is different for each label made in the same batch or at least able to vary in the batch depending on stated rules.

The present invention, in the afore said aspect, may have at least one of the favorite features described hereinbelow.

Conveniently, the process comprises a step of drying the ink of the array printed on the first surface of the first medium.

Preferably, the ink is dried through evaporation of the solvent (usually water and alcohols having low molecular weight) contained therein.

Advantageously, the first medium is made of paper material adapted to withstand temperatures greater than 120°.

Conveniently, the step of printing the image array on a first surface of a first medium is carried out through a digital printing process having a print resolution of at least 150*150 DPI.

Preferably, the process further comprises the steps of:

- generating fixed information of graphic type; and
- assembling and associating in an assembler at least one piece of fixed information per each cell of said array in compliance with a predetermined order.

Advantageously, the process also comprises the steps of:

- generating at least one second sequence of variable information;
- associating, in a database, a piece of information of said at least one second sequence of variable information with a piece of variable information of said first sequence of variable information, in compliance with a predetermined order;
- inserting, by the use of an image assembler, the graphic form that can be associated with each of said second variable information into the same cell of a graphics array with size m×n in which the first piece of information has been inserted.

Conveniently, the associations are stored in a database.

Conveniently, the process comprises at least one second and additional step of printing on the rear side of the second medium of fabric, by sublimation heat transfer.

Advantageously, the surface of the first medium is printed through a digital inkjet printing process.

Preferably, the surface of the first medium is printed through an inkjet printing process.

Even more preferably, the surface of the first medium is printed through an inkjet printing process with inks having viscosity of less than 100 mPas, preferably less than 10 mPas (millipascal-second).

Advantageously, the surface of the first medium is printed through a monochromatic inkjet printing process.

Conveniently, the surface of the first medium is printed with a color inkjet printing process in which the colors are obtained by overlapping and mixing, in the liquid phase, at least 4 base colors (CMYK).

Preferably, the process comprises the steps of:

- subjecting the second medium of fabric to a high intensity backlight, downstream of the second printing;
- photographing the overlap of the image being on a cell of the array formed by the combination of the drawing on the front side and the drawing on the rear side of said second medium of fabric;
- storing said image in a database, by taking care of properly associating it with other information contained in the cell.

Advantageously, the medium of fabric comprises synthetic fibers.

Preferably, the medium of fabric comprises synthetic fibers in the weft and, anyway, fibers able to be cut in a percentage greater than 50% based on the total.

Conveniently, the medium of fabric comprises polyester fibers that are untreated for printing.

Advantageously the second medium of fabric is cut, with cutting parallel to the feeding direction of said second medium of fabric, in ribbons or label rows having size adapted to be wound on bobbins.

Preferably, the process comprises a further step of cutting each row of labels in a direction transverse to the row of labels itself.

BRIEF DESCRIPTION OF THE DRAWINGS

Further characteristics and advantages of the invention will be more evident from the detailed description of some preferred embodiments, but not exclusive, of a new process for making a fabric label containing at least one piece of unique and electronically-readable variable information according to the present invention.

Such a description will be hereinafter explained referring to the attached drawings, provided for purposes of illustrations only, and thereby not limitative, wherein.

DETAILED DESCRIPTION OF EMBODIMENTS OF THE INVENTION

Figure 1:
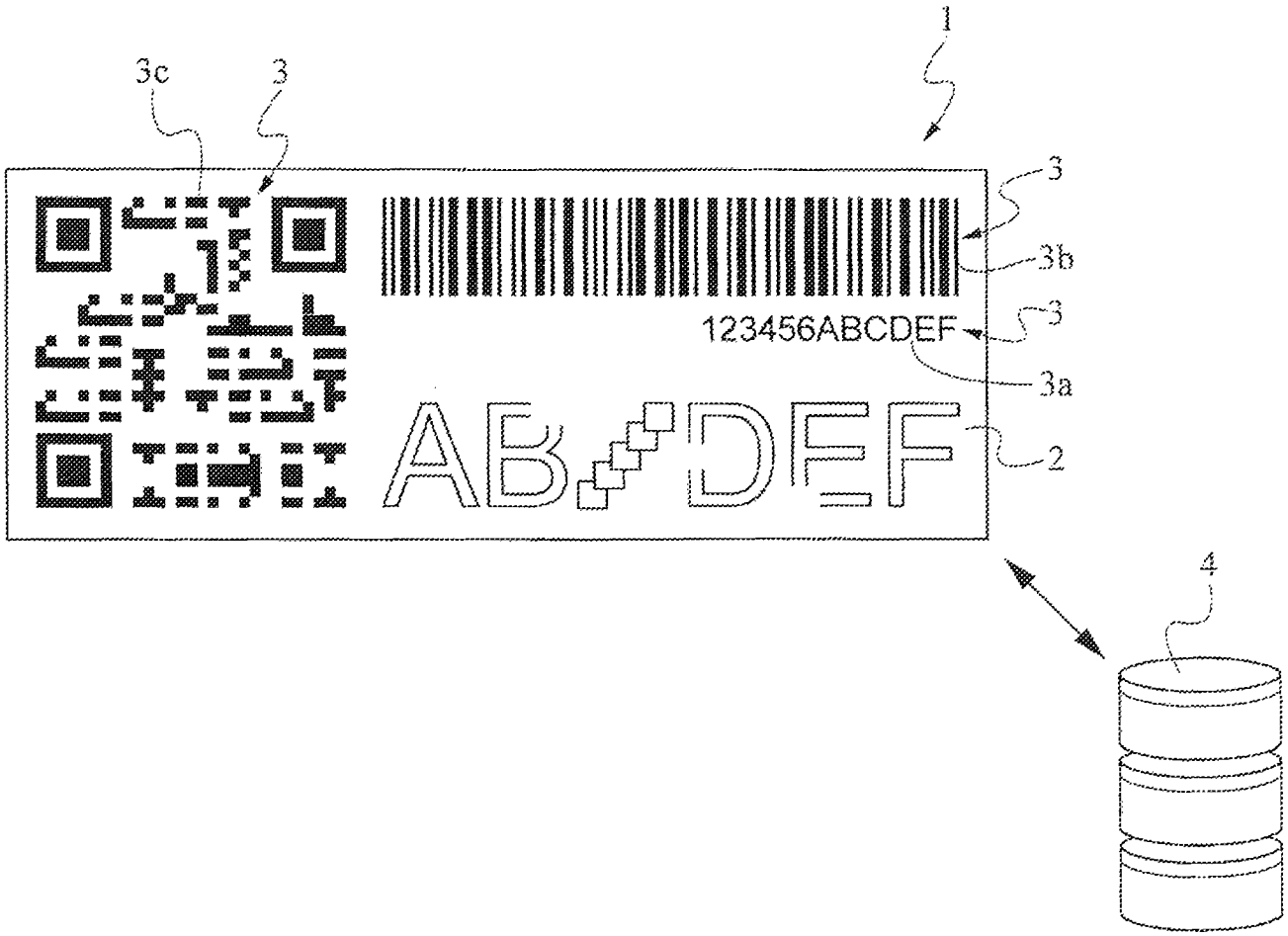
FIG. 1 is a front schematic view and, in case, a rear schematic view of a fabric label according to the present invention.

FIG. 1 shows a fabric label 1 containing a piece of unique electronically-readable information according to the present invention.

The label 1 is made of fabric.

In the embodiment shown in FIG. 1, the label 1 is made of a fabric of chemical synthetic fibers compatible with the inks used for printing on the substrate 7 and that are able to be cut by melting them on hot knife or by ultrasonic cutting obtained by assembling a knife on a sonotrode. This selected fabric provides clear advantages in the cutting step during the making process.

Preferably, for this purpose the label 1 is made of a fabric comprising synthetic fibers in the weft in a percentage higher than 50% based on the total.

Advantageously, the label 1 is made of a fabric comprising polyester fibers not treated with chemical compounds, which are adapted to control the migration or promote the adhesion of the ink.

In the embodiment shown in FIG. 1, the label 1 comprises a piece of information of the fixed type 2 and one piece, or more, of information of the variable type 3.

"Information of a fixed type" means a piece of information equal for all the labels made in the same batch.

Fixed information can be a graphical representation of any type, an alphanumeric writing, a drawing, a trademark, a logo, a bar code or a two-dimensional code.

On the contrary, "information of a variable type" means information that is different for each label made in the same batch or at least able to vary in the batch depending on stated rules.

Both the fixed information 2 and variable information 3 of a label 1 are stored in a suitable database 4 and can also be associated with other production numbers such as a serial number of the bobbin, of the bolt batch and print batch, as described in greater detail below.

The information of the variable type 3 may be:

randomly generated;

the result of mathematical logics (e.g. increasing or decreasing upon m or n variation);

correlated one to another by even complex logics or without any pre-established correlation between them;

predefined by the user depending on his/her needs.

In the embodiment shown in FIG. 1, the label comprises one first piece of information of the fixed type 2 denoted by a colored logo or trademark AB/DEF, and three information of the variable type 3.

The three information of variable type 3 consists of a first alphanumeric code 3*a* readable by every person to the naked eye, a second bar code 3*b* and a third code of two-dimensional type 3*c*, such as a QR code.

The heat transfer printing process allows the fixed information 2 and the variable information 3 to be color printed, to be perfectly resistant to washing also on synthetic materials such as polyester and to be obtained with inks of hypoallergenic type.

In addition, the heat transfer printing process allows the variable information 3, once printed, to be readable with electronic equipment and to not have an excessive limitation in the information density to be inserted through mono and two-dimensional codes.

The thermal transfer printing process further allows a held down ink consumption and a high print definition just because the ink, once transferred onto the bolt 7, doesn't tend to "flow" by capillarity along the fibers and then to reduce the definition of the image.

The label 1 shown in FIG. 1 is made by a process according to the present invention to be described hereinbelow.

In the embodiment described by way of example, the process starts with the provision of a bolt of fabric 7, preferably made of non-treated polyester for the purposes of controlling the diffusion of the ink and the adhesion thereof to the fiber, which has a basis weight of about 140 g/m2, width 1100 mm and length of 150 meters.

The ribbon-shaped fabric bolt 7 is identified by a batch identifier not visible to the user and inserted in the fabric itself with such a pitch that there is at least one batch number per each label 1.

In this step or preferably subsequently, the batch number of the bolt is stored in a suitable database 4.

Moreover, it is generated at least one array 5 formed by m columns and n rows. That is to say an array 5 formed by m×n cells, each one associated with a label.

It is further generated at least one first sequence of variable information 3.

Figure 2:
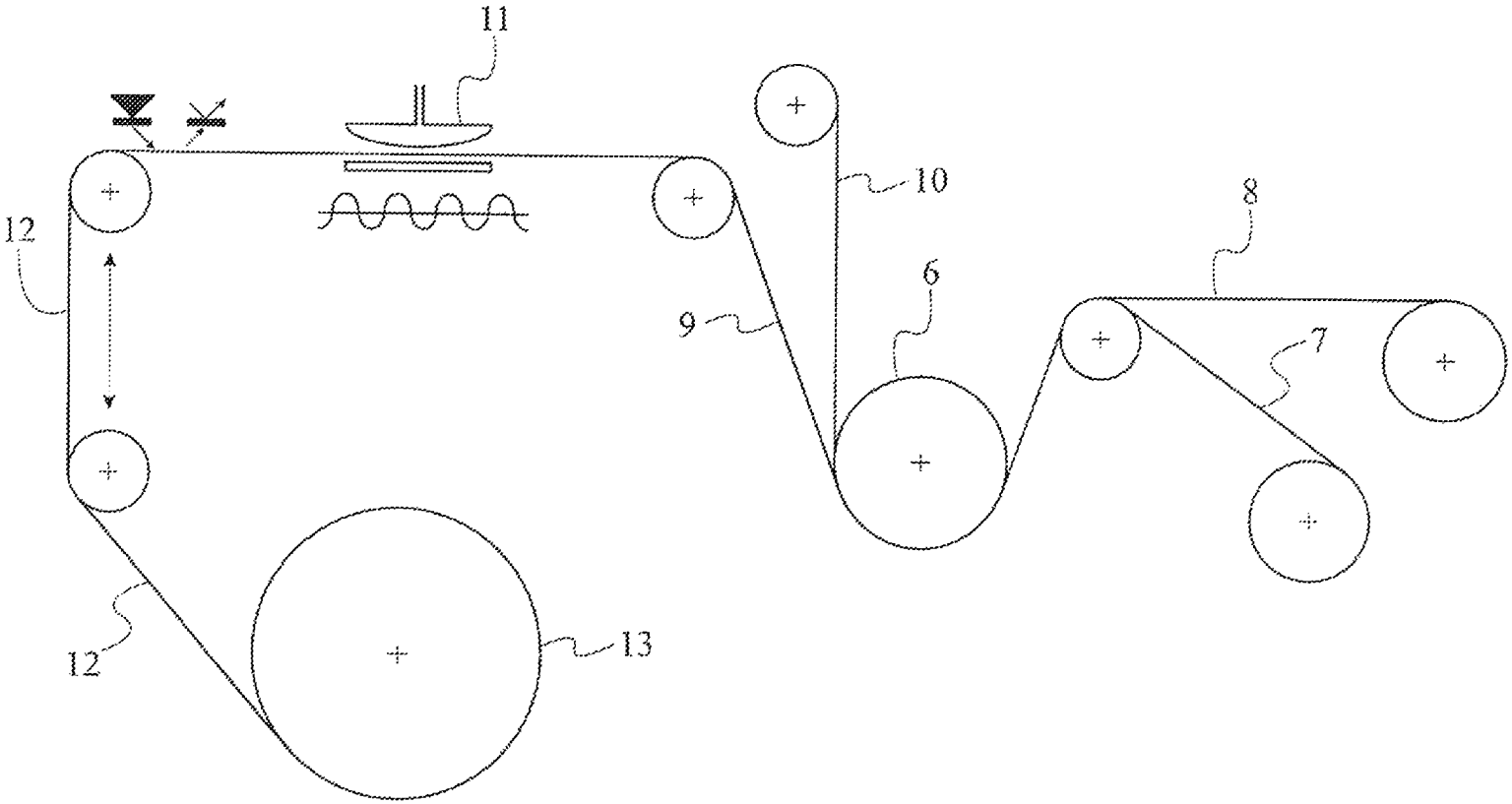
FIG. 2 is a schematic view of some steps of the process for making a fabric label containing at least one piece of unique and electronically-readable variable information according to the present invention.
Figure 3:
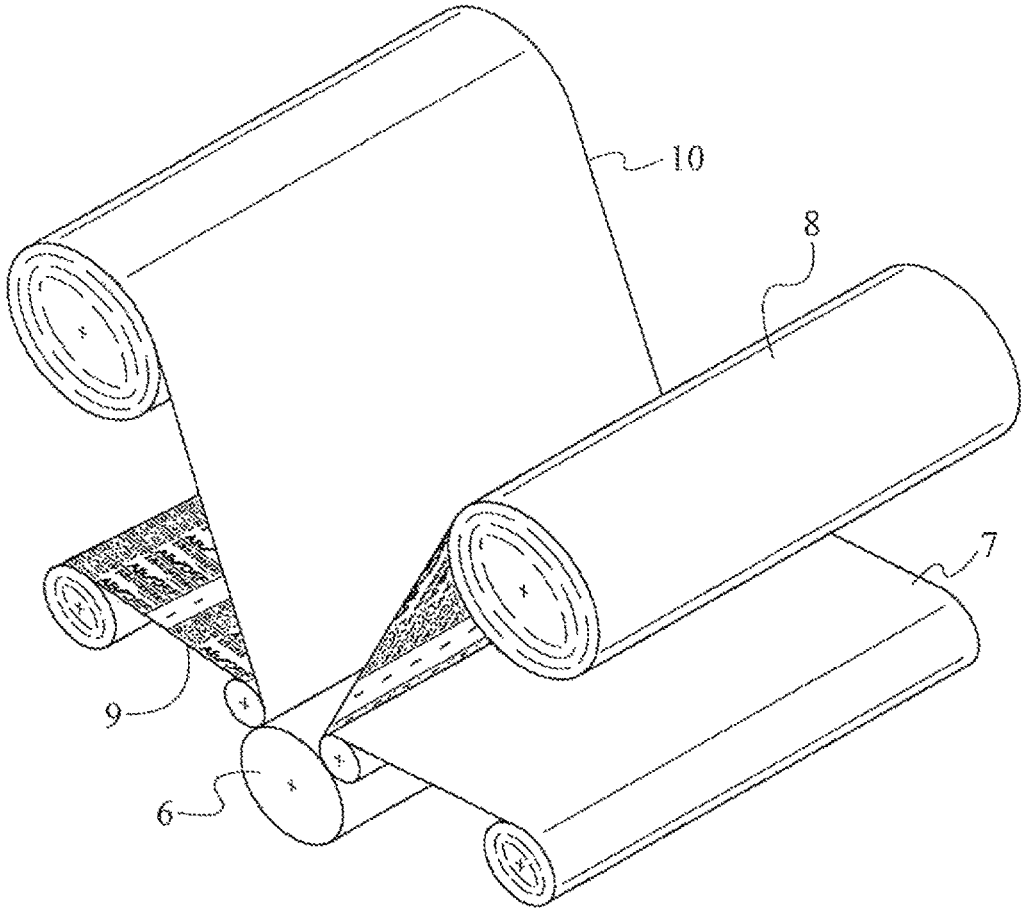
FIG. 3 is a schematic view of the heat transfer step in a calender.
Figure 4:
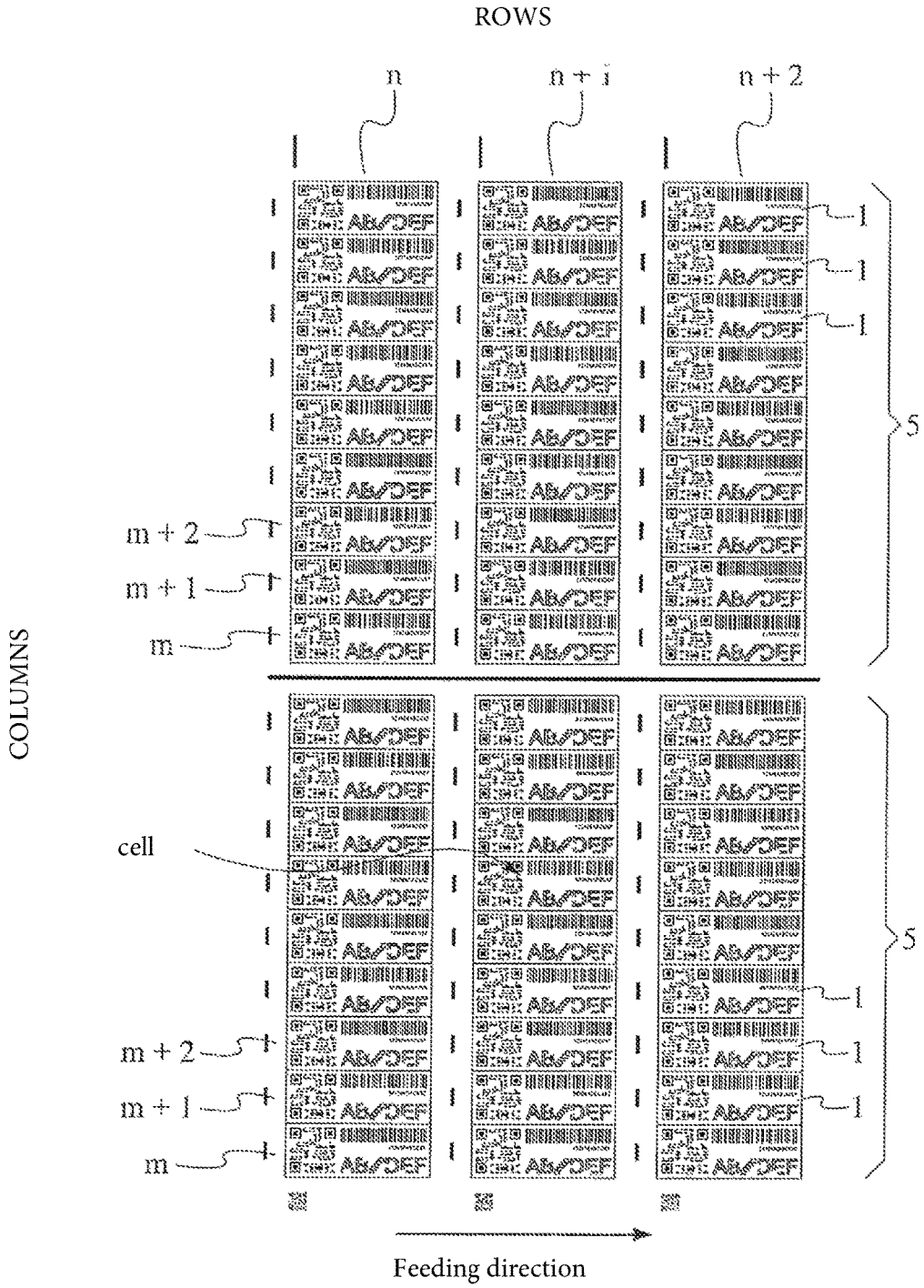
FIG. 4 is a schematic view of an m×n array according to the present invention.

In particular, with reference to the embodiment of FIGS. 2-4, three sequences of variable information 3 and one sequence of fixed information 2 are generated.

Each variable information 3 of the first, second, and/or third sequence of variable information 3 can be associated with only one label 1, as explained below.

By way of example, variable information 3 graphically depicted in a first sequence 3*a* of variable information 3 depicted by an alphanumeric string, a second sequence of variable information 3*b* depicted by a sequence of bar codes, a third sequence of variable information 3*c* depicted by a sequence of two-dimensional QR codes and a sequence of fixed information 2 depicted by a sequence of all identical "AB/DEF" logos, are generated.

A piece of variable information 3*b* of the second sequence of variable information and a piece of variable information 3*c* of the third sequence of variable information are associated with each piece of variable information 3*a* of the first information sequence.

The afore said association is stored in a database 4.

With reference to the embodiment shown in the figures, a QR code of the second sequence of variable information is associated with each bar code of the first sequence of variable information.

The afore said association of a piece of information of the first sequence with a piece of information of the second and third sequences is assembled according to a predetermined order in a cell of the graphics array (FIG. 4) through a graphic assembler and by storing the association and the array cell in a database 4, or in greater detail the association and the position of the array cell.

Each cell is also associated with a piece of fixed information of the sequence of fixed information.

Even images free of variable and/or fixed information can be inserted in the graphics array in order to manage the process downstream of the transfer. These images can also be inserted in spaces intended to be discarded during subsequent processes.

The variable information 3 and fixed information 2 representing the array 5 are then printed in sequence with an inkjet printing process on a first surface of a first film-shaped medium 8, the latter being preferably made of paper and suitable for subsequently heat transferring what is printed on the fabric. Inks suitable for the sublimation heat transfer on the selected fabric are used for printing, the fabric preferably consists of polyester yarn chemically untreated in order to facilitate the printing processes.

Alternatively, the first medium 8 and, in particular, its first upper surface could be printed through a digital toner printing process.

Therefore, the process continues with a step of drying the ink of the array 5 printed on the first surface of the first medium 8.

Preferably, the ink is dried through evaporation of the solvent (usually water and alcohols having low molecular weight) contained therein.

Advantageously, the first medium 8 is made of paper material adapted to withstand temperatures greater than 120°.

The step of printing the image array 5 on a first surface of a first medium 8 is carried out through a digital printing technology, such as an inkjet printing technology, having a print resolution of at least 150*150 DPI.

Even more preferably, the surface of the first medium is printed through an inkjet printing process with inks having viscosity of less than 100 mPas, preferably less than 10 mPas.

Advantageously, the surface of the first medium 8 is printed through a monochromatic inkjet printing process.

Conveniently, the surface of the first medium 8 is printed with a color inkjet printing process in which the colors are obtained by overlapping and mixing, in the liquid phase, at least 4 base colors (CMYK).

At this point of the process, a first medium 8 in the form of a film preferably made of paper material is thus obtained, on which an image array 5 (mirrored with respect to those that will be on the labels) of at least m columns and at least n rows, is printed on a surface.

Therefore, each cell of the array 5 contains at least one piece of variable information 3 (but the exceptions mentioned above) and possibly the fixed information 2.

Preferably, the first paper medium 8 has a width greater than 12 mm.

The size of the width of the first paper medium 8 suggests that, in a first paper medium 8, generally for the width thereof there is an array 5 including at least two columns m.

Each column m will make a row of labels 1.

The so-obtained array 5 printed on a first upper surface of the paper medium 8 in the film form, in particular what is graphically depicted on the array 5, is transferred on a first medium 8 of fabric that preferably contains synthetic fibers, such as polyester.

For this purpose, the first upper surface of the first medium 8 is placed in contact with a bolt of fabric 7.

The transfer takes place by means of a sublimation process in which the ink of the array 5 of the first medium 8 sublimates and deposits by adhering to the bolt of fabric 7. This process step is accomplished by heat, in a calender 6.

FIG. 3 shows, by way of example, the calender 6 where the medium 8 is input as a film made of paper material having on one side, the lower one with reference to FIG. 3, the array 5 m×n containing the fixed information 2 and the variable information 3.

Also the bolt 7 of fabric enters the calender 6, in addition to the paper medium 8 input as a film.

The first medium 8 in the form of a paper film containing the array 5 and the bolt 7 of fabric are ribbon-shaped.

The sublimation is accomplished in the calender 6 by transferring the array 5 containing the fixed information 2 and the variable information 3 from the first medium 8 in the form of a paper film to the bolt 7 of fabric.

In detail, the array 5 is transferred from the first surface of the first medium 8 to the surface of the bolt 7 being in contact with the first upper surface of the first medium 8.

A second medium 9 of fabric, containing the array 5 and a paper ribbon 10 from which the array 5 has been removed, is outputting from the calender 6.

The product of this process step is a second medium 9 of fabric on which m*n images (each positioned on m columns and n rows) are visible.

The second medium 9 is then reduced by a cutter 11 able to cut the second medium 9 in m ribbons or label rows 12 that are wound on bobbins 13.

The cutting step of the second medium 9 of fabric in ribbons or label rows 12 having size adapted to be wound on bobbins 13 comprises parallel cuts along the feeding direction of said second medium 9 of fabric.

Said cutting process can also occur in a second time on dedicated equipment. In this case the medium 9 of fabric can be processed, for example by ironing, in order to reduce wastes or make it easier for cut-processing and, in this case, it is further possible to repeat the above described transferring process also on the back by using another first medium 8.

Hot knives or ultrasounds can be used for the cutting, since they allow obtaining a cut with little melting that prevents a frayed portion to be formed in the cutting zone with the need of no more machining.

m ribbons or label rows 12 will be produced from the cutting operation, having a cross size substantially corresponding to that one of the width of a cell.

In FIG. 2, for the sake of simplicity, only a small ribbon or label row 12 is depicted, but it should be understood that they are in the number of m, as many as the columns of the array 5 were.

During, or before, the cutting process of the second medium 9 of fabric, the latter having the array 5 m×n on a surface, an automatic reading of variable data contained in each cell may be performed in order to check the print quality.

In this step it is also possible to record in a database 4 the fixed information 2 and the variable information 3 contained in each cell in association with other known information.

In FIG. 2 the ribbon or label row 12 is shown as wound on a bobbin 13.

It is also possible to take photos of the cells subjected to backlight of sufficient intensity so that information being on the back become visible, and to store these images in a database.

Subsequently, images contained in each bobbin 13 can be cut transversely and hence become labels 1 that can be applied to items of clothing, fashion accessories or any object to be identified through a label 1 of fabric.

In other words to make the labels 1, as shown in FIG. 1, there is generally a further cutting operation of each row 12 of labels in a direction transverse to the row 12 of labels itself.

In the following an example of labels implemented by the above described process is described.

- A bolt of fabric made of polyester 5 of satinette type, having a basis weight of about 140 g/m2, width of 1100 mm and length of 150 meters, is obtained. The bolt is identified by a batch number not visible to the user.
- Two arrays are generated, which have the following identical size m=40 n=2500 and contain variable information:

Array Element 1

Each element (cell) contains an URL address containing a total of 48 alphanumeric characters in this format: http://www.abcd.eu/wxyz.php?i=123456789012345678

Array Elements 2

Each element (cell) contains a number of 10 numeric characters and linked to at least another number of the same array with mathematical logic.

- 2500 rows, each containing 40 images, are generated:
  - Said URL address inserted in a 12 mm wide QR code type containing individual elements of a size of about 0.3 mm,
  - Said number linked to another number inserted in a bar code of Interleaved 2/5 type,
  - Said number linked to another number in alphanumeric format,
  - A drawing of a logo in four colors,
  - Other drawings auxiliary for the printing or cutting.
- Assembling these rows in a graphic editor (by taking care to follow their ascending or descending progression), and printing through multipass inkjet printer on a paper sheet having width of 1100 mm and length of approximately 150 meters by sublimation.
- Transferring the printed drawing on the fabric by means of the above described process of sublimation at about 200 C.
- Reading all QR and Interleaved 2/5 codes for quality control, reporting unreadable codes in a satisfactory manner.
- Storing, in a database, the following associated data: (i) information read in the QR, (ii) number of the column (m), (iii) number of the row (n), (iv) print batch number, (v) bolt batch number
- Activating the read QR codes so that they can used in the database.
- Reducing the bolt to 40 child bobbins by ultrasonic cutting and elimination of parts of the excess fabric. The width of these child bobbins is 22 mm.
- Activating the read QR codes so that they can used in the database.

The above described process of print transferring allows obtaining a ribbon of fabric printed on one side only on the front side, with reference to FIG. 2-4, thereby leaving the rear side substantially neutral and available for another printing. This is a feature of the sublimation printing which, by preventing the ink from "flowing" by capillarity, also allows the rear side of the print to be available for more prints.

According to another alternative embodiment, the process then provides for another and additional printing step on the rear side of the fabric by sublimation.

Such a second printing step occurs upstream or downstream of the above described printing step on the front side of the medium of fabric and, preferably, before the step of cutting to size the fabric ribbon for the bobbins.

In the second step of printing on the rear side of the medium 9 of fabric, a drawing or a series of designs different from that on the front side, is transferred by sublimation.

Nothing impedes that what is printed on the rear side has been generated with what described above for the lower side with information identical to or different from those printed on this part.

According to another embodiment, the Applicant exploited the actual impossibility to align (to tune in technical terms) the graphics on the rear side with those on the front side, in order to realize a security label that cannot be cloned.

In fact, with technical knowledges of the state of the art, it is not possible to tune the images on the two bolt sides if the latter are applied through the processes described herein, therefore it is not practical to try to clone a label also by using the same process described in this patent application.

Other processes (i) do not allow making prints with information on the two sides and/or (ii) do not allow obtaining images having sufficient definition for the electronic reading and/or (iii) do not allow the colored printing in grayscales and/or (iv) do not allow variable information to be printed and/or (v) provide a print quality clearly different from that obtained by the process described in this patent application.

Preferably, according to this embodiment, the drawing transferred on the rear side of the medium of fabric has a pitch different from that used for the printing of the rows (n) on the front side. By combining this arrangement with the impossibility of maintaining the tune between the transfer on the front side and that one on the back side, the combination of images or information, on the front side to the back side is not necessarily unique per each cell or label and can be considered as a fingerprint of the same label.

Some visual arrangements, such as making different drawings and/or that have different and/or particular pitches, allows simplifying the detection of differences among labels, when viewed in transparency.

Figure 5:
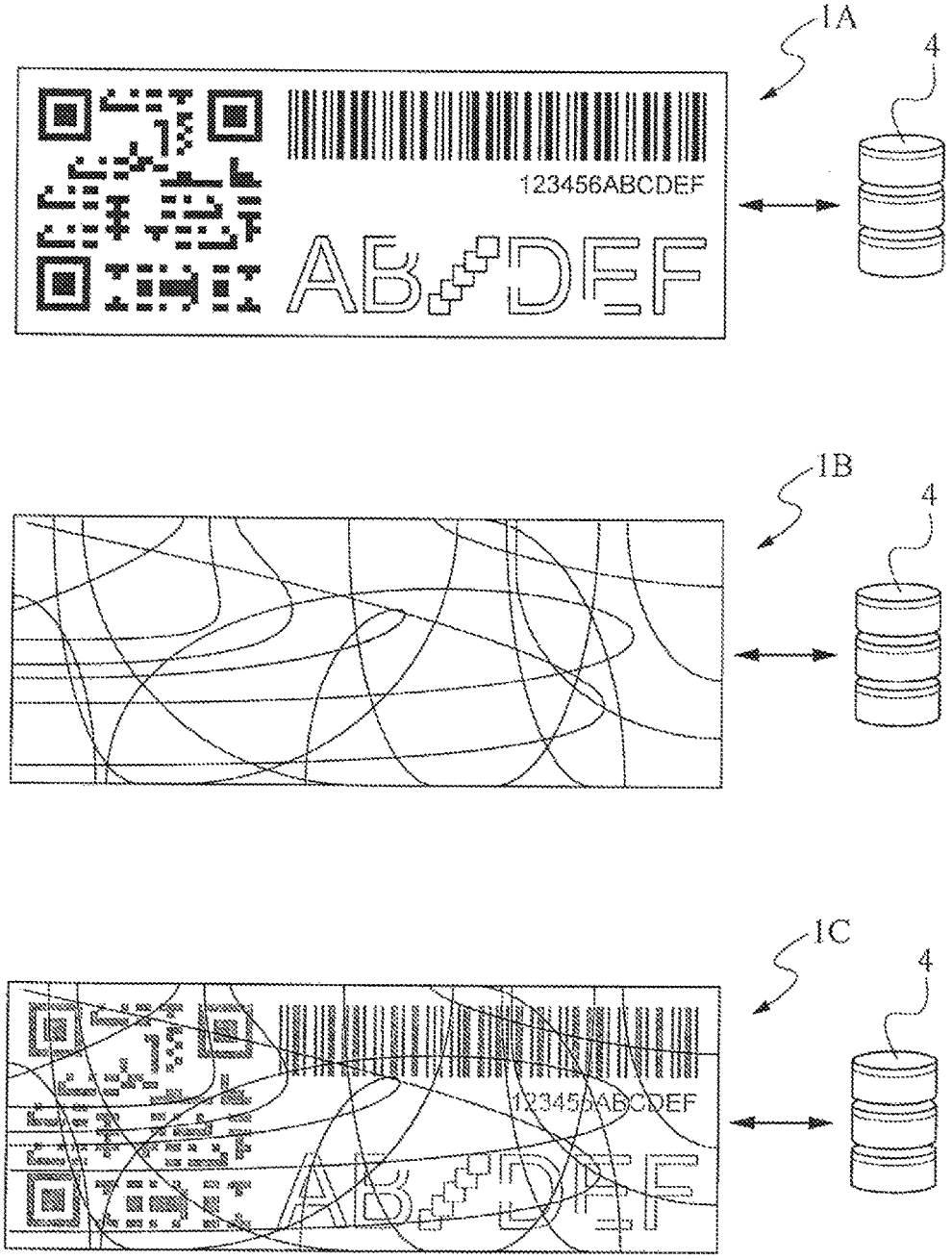
FIG. 5 is a schematic view of a label according to a second embodiment of the present invention, in which the front portion of the label is shown, the rear portion of the label being subjected to backlight.

At this point FIG. 5 describes how, by subjecting the fabric at high intensity backlight, it is possible to proceed to a photographing operation that takes a photo of the image present on a cell on the front side and of the drawing on the same cell at the rear side.

The image being captured on the photo is stored in association with the identifying data of the label 1, that will contain it in a database 4. In case of doubtful authenticity of the label, the backlighted image thereof can be compared with that originally stored in the database.

According to still another embodiment of the present invention, the process provides that the print on the label back also comprises fixed and variable information, thereby doubling the space available for such information with respect to direct inkjet printing or weaving.

The process continues with the steps of cutting and additional ones as previously described with reference to FIGS. 2-4.

The process of producing a fabric label according to the present invention, with respect to the known art, allows obtaining some undoubted benefits:

A very high print definition on the fabric, even if not treated, is obtained: this is suitable for printing two-dimensional codes (e.g., QR) easily readable by smartphone, or readers of two-dimensional bar codes commercially available on the market, also with a resolution of individual points even less than 0.2*0.2 mm;

Labels of the highest quality can be printed in four colors by managing grayscales;

The printing on synthetic fabric is possible, in particular on polyester, with evident advantages in the cutting process and cost of materials;

The printing at first on very large fabric (up to 2000 mm of width) and then the cutting thereof, are possible with obvious advantages in productivity and traceability of information;

The cutting of the fabric with thermal, ultrasonic or laser cutting is possible, with obvious advantages due to the fact that these techniques prevent the fabric from "fraying";

The consumption of inks is substantially lower than that of direct printing;

Any printing error can be detected before the transfer onto the fabric, with undoubted advantages due to the waste limitation;

The fabric should not be pre-treated for the printing with materials that tend to make it too rigid to be "wearable";

The transferred fabric (9) should not be further processed by finishing to fix the colors;

The back of the label, not being ink-permeated, is still clean and usable for other purposes such as for example the printing of other information and/or the making of a not reproducible (cloneable) security label;

The present invention has been described referring to some embodiments. To the embodiments herein represented in detail various modifications can be made, anyway remaining in the protection scope of the invention, defined by the following claims. Only by way of example, it is possible to replace the fabric intended as the material obtained by weaving a weft in a warp with other materials, such as nonwoven fabric (TNT), coagulated materials, leather or other. Even diagrams of the machines depicted for the transfer shall be intended for indicative purpose only, in order to denote the principle of the process. As regards the printing of the array, using other digital printing processes that require to manage variable information, was also possible.

The invention claimed is:

1. Process for making a fabric label containing one piece of unique electronically-readable information; said process comprising:

providing a fabric bolt made of a material comprising synthetic fibers at least in the weft;

generating at least one array of m×n cells, n being the number of rows and m the number of columns;

generating at least one first sequence of variable information;

associating the variable information to the cells of the array in compliance with a predetermined logic;

inserting, by the use of an image assembler, a graphic form that can be associated with each of said variable information into a cell of a graphics array with size m×n;

printing said array of images on a first surface of a first medium through a digital printing process, said first medium being a non-fabric material;

contacting said first surface with said fabric bolt;

transferring said print, by heating and sublimation, onto said bolt to generate a second medium comprising a fabric comprising said array on a fabric surface thereof;

storing in a database the variable information printed on each label, taking care of tuning the column m and the row n on which every information has been positioned; and cutting said second medium of fabric.

2. The process for making a fabric label according to claim 1, wherein said first medium is made of paper material adapted to withstand temperatures greater than 120°.

3. The process for making a fabric label according to claim 1, wherein said printing said array of images on a first surface of a first medium is carried out through a digital printing process having a print resolution of at least 150*150 DPI.

4. The process for making a fabric label according to claim 1, further comprising:

generating a sequence of fixed information; and assembling and associating in an assembler at least one piece of fixed information per each cell of said array in compliance with a predetermined order.

5. The process for making a fabric label according to claim 1, wherein said number m of columns is an integer larger than 1.

6. The process for making a fabric label according to claim 1, further comprising:

generating at least one second sequence of variable information;

associating, in a database, a piece of information of said at least one second sequence of variable information with a piece of variable information of said first sequence of variable information;

assembling in an assembler, per each cell of said array in compliance with a predetermined order, a piece of variable information of said at least one second sequence of variable information with a piece of variable information of said first sequence of variable information.

7. The process for making a fabric label according to claim 1, wherein said associations are stored in a database.

8. The process for making a fabric label according to claim 1, wherein said fabric bolt comprises synthetic fibers in a percentage higher than 50% based on the total of the yarn used for the weft.

9. The process for making a fabric label according to claim 1, wherein said fabric bolt comprises raw polyester fibers.

10. The process for making a fabric label according to claim 1, wherein said surface of the first medium is printed through a digital inkjet printing process.

11. The process for making a fabric label according to claim 1, wherein said surface of the first medium is printed through an inkjet printing process.

12. The process for making a fabric label according to claim 1, wherein said surface of the first medium is printed through a digital toner printing process.

13. The process for making a fabric label according to claim 1, wherein said cutting said second medium of fabric comprises cutting said medium of fabric in ribbons or label rows having size adapted to be wound on bobbins having a width as wide as a width of the single cell, or a multiple thereof.

14. The process for making a fabric label according to claim 13, wherein said cutting said second medium of fabric in ribbons or label rows having size adapted to be wound on bobbins comprises parallel cuts along the feeding direction of said second medium of fabric.

15. The process for making a fabric label according to claim 14, wherein said parallel cuts are obtained by ultrasonic cutting by a knife on a sonotrode.

16. The process for making a fabric label according to claim 13, further comprising further cutting each row of labels in a direction transverse to the row of labels itself.

17. The process for making a fabric label according to claim 1, wherein said cutting said second medium of fabric comprises laser cutting.

18. The process for making a fabric label according to claim 1, wherein said variable information is depicted by electronically readable bar codes having high information density which are obtained with bars having a minimum width between 0.1 and 1.0 mm.

19. The process for making a fabric label according to claim 1, wherein said variable information is depicted by electronically readable two-dimensional codes with single information cells having a minimum width between 0.2 and 0.5 mm.

20. The process for making a fabric label according to claim 1, further comprising printing on a back surface opposite said fabric surface of said second medium, by sublimation heat transfer.

21. Process for making a fabric label containing one piece of unique electronically-readable information; said process comprising:

providing a fabric bolt made of a material comprising synthetic fibers at least in the weft;

generating at least one array of m×n cells, n being the number of rows and m the number of columns;

generating at least one first sequence of variable information;

associating the variable information to the cells of the array in compliance with a predetermined logic;

inserting, by the use of an image assembler, a graphic form that can be associated with each of said variable information into a cell of a graphics array with size m×n;

printing said array of images on a first surface of a first medium through a digital printing process, said first medium being a non-fabric material;

contacting said first surface with said fabric bolt;

transferring said print, by heating and sublimation, onto said bolt to generate a second medium comprising a fabric comprising said array on a fabric surface thereof;

storing in a database the variable information printed on each label, taking care of tuning the column m and the row n on which every information has been positioned; and cutting said second medium of fabric, and further comprising:

drying ink of said array printed on the first surface of said first medium prior to said contacting said first surface with said fabric bolt.

22. Process for making a fabric label containing one piece of unique electronically-readable information; said process comprising:

providing a fabric bolt made of a material comprising synthetic fibers at least in the weft;

generating at least one array of m×n cells, n being the number of rows and m the number of columns;

generating at least one first sequence of variable information;

associating the variable information to the cells of the array in compliance with a predetermined logic;

inserting, by the use of an image assembler, a graphic form that can be associated with each of said variable information into a cell of a graphics array with size m×n;

printing said array of images on a first surface of a first medium through a digital printing process, said first medium being a non-fabric material;

contacting said first surface with said fabric bolt;

transferring said print, by heating and sublimation, onto said bolt to generate a second medium comprising a fabric comprising said array on a fabric surface thereof;

storing in a database the variable information printed on each label, taking care of tuning the column m and the row n on which every information has been positioned; and cutting said second medium of fabric, further comprising at least printing on the opposed rear side of the second medium of fabric.

23. The process for making a fabric label according to claim 22, further comprising:

subjecting the second medium of fabric to a high intensity backlight, downstream of the second printing;

photographing the overlap of the image being on a cell of the array formed by the combination of the drawing on the front side and the drawing on the rear side of said second medium of fabric;

storing the image in a database.

* * * * *